United States Patent [19]

Swager

[11] 4,085,818

[45] Apr. 25, 1978

[54] PLASTIC LADDER AND SAFETY DEVICE

[76] Inventor: William E. Swager, P.O. Box 656, Fremont, Ind. 46737

[21] Appl. No.: 688,145

[22] Filed: May 20, 1976

[51] Int. Cl.[2] ..... E06C 5/36; E06C 7/08

[52] U.S. Cl. ..... 182/47; 182/8; 182/137

[58] Field of Search ..... 182/8, 219, 3, 5, 46, 182/194, 137

[56] References Cited

U.S. PATENT DOCUMENTS

| | | | |
|---|---|---|---|
| 765,223 | 7/1904 | Bayless | 182/219 |
| 2,616,609 | 11/1952 | Herod | 182/8 |
| 3,348,632 | 10/1967 | Swager | 182/8 |
| 3,454,130 | 7/1969 | Pellandine | 182/46 |
| 3,523,591 | 8/1970 | Fountain | 182/8 |
| 3,852,943 | 12/1974 | Healy | 182/5 |
| 3,885,647 | 5/1975 | Acosta | 182/8 |

FOREIGN PATENT DOCUMENTS

| | | | |
|---|---|---|---|
| 1,473,300 | 2/1967 | France | 182/8 |

*Primary Examiner*—Reinaldo P. Machado
*Attorney, Agent, or Firm*—Sol B. Wiczer

[57] ABSTRACT

A safety clamping device for use by climbers, combined with a fiber reinforced plastic rail upon which the clamp ultimately slides or grips. The clamping device has a pivotally mounted plate therein having a triggering arm extending outward for being engaged by a rope or chain, having one end carried by the belt mounted about the waist of the climber and the other being fastened to the triggering arm so that the climber slidably carries the clamping device upon the rail as he moves downward and upward on the ladder to which the rail is fastened. An inner end of the plate of the clamp is cam shaped and which is biased by a spring against the rail, but which, as supported by the climber, offsets the gripping by the cam so that the clamp easily slides with the climber as he ascends or descends the ladder, but ultimately grips the rail if the climber descends or falls rapidly, firmly engaging the rail to tightly clamp thereagainst as a safety device.

13 Claims, 8 Drawing Figures

PLASTIC LADDER AND SAFETY DEVICE

The invention relates to the combination of a safety clamp and a plastic rail of a step-ladder upon which the clamp is designed to slide and to a safety clamp constructed for slidable mounting on a rail, preferably a reinforced plastic rail, fastenable to, or forming part of, a step-ladder.

In one aspect, this invention is directed to the combination of a reinforced plastic step-ladder comprising a strong fiber, such as glass fiber, bonded by plastic into a rail forming part of a strong ladder body, comprising slide rails held together by rungs in which one or both of the side rails is shaped to slidingly receive a clamping means thereon, adapted as a safety clamp. The clamp is constructed to be freely slidable on the ladder rail, but it carries a cam-like gripping means actuated by a triggering arm to grip the rail by a downward pull upon the triggering arm, securing the clamp upon the rail against further movement, despite very heavy pull, but the clamping means is easily slidable on the rail in the reverse movement, such as vertically ascending or even descending movement in the absence of a pull against the triggering arm strong enough to actuate the clamping means. The triggering arm is adapted to be fastened to one end of a chain or rope which fastens at its other end to a belt mounted, for example, about the waist of the user, so that upon ascending the ladder the user can easily and slidingly pull the clamping means upwardly without significant resistance and even descending the ladder the clamp will slide downward with the user. The clamping means is spring biased to hold the cam-like gripping element from engaging the rail so that the clamp may slide freely upward or downward thereof without discomfort to the user of the ladder in ascent or descent. The safety clamp will be actuated by a fast or signifacnt downward pull against the spring biased clamp, the strong downward pull causing the cam to engage and firmly grip the surface of the rail thereby to prevent further movement of the clamp on the rail, such firm clamping of the rail preventing a fall or similar mishap to the person using the clamp as he uses the ladder.

In an alternate construction, the rail above, having means upon which the clamp may be slidingly mounted, can be fastened centrally to the rungs of a conventional ladder, and the clamp slidably mounted on the rail thereon moves upward from the center position of the rail, leaving the rung positions of the ladder free on both sides of the rail for normal or conventional use as a ladder, otherwise of conventional construction.

In a further alternative, the separate rail may be fastened to the side, such as to the web of one or the other, or even both, of the side rails, whereby the sliding rail becomes a separate element independently mountable to one or both sides of a conventional ladder. In all such cases, at least the rail upon which the clamp is slidingly mounted will be constructed of fiber reinforced plastic easily and firmly gripped by the cam-type clamping means.

In such construction, it is to be noted, that the plastic may be any commonly strong plastic, typically a linear alkyd, or a polyvinyl resin, such as polyvinyl chloride, polyvinyl acetate, polyvinyl acetal or polystyrene and polymethyl methecrylate, polyacrylonitrile and mixtures and co-polymers of said polymers. Such polymers are conventionally mixed and filled, generally to the extent possible, with at least 2% by weight thereof, with a reinforcing fiber, typically glass fiber. Other fiber fillers, such as asbestos, rayon, nylon and such inorganic fibers as graphite or metal wire, may also be used. The advantage of that kind of ladder, suitably reinforced as stated, can be formed with very good strength and light weight. It resists corrosion and is non-electro conductive. Such ladders may be mounted on ships, towers and particularly in highly exposed upper tower positions, buildings and chemical plants or refineries where use of a safety clamp is indicated, and so that it will resist electric conductivity and corrosion while providing adequate safety to the user. Its great advantage in the present combination is that the plastic itself becomes more firmly and tightly gripped by the cam-type of safety clamp used in the combination hereof, the sliding type of clamp upon said plastic reinforced fiber is outstanding as a safety feature of construction where ever such ladder is useful.

In an alternate aspect of this invention, a cam gripping type of clamp is provided in which the body of the clamp is annularly shaped to be mounted about the rail for slidable engagement thereof, and the cam is mounted for radial movement against an exposed edge of said plastic rail. The cam is preferably formed integrally with the triggering arm extending downward and outward of the clamp for being secured to a chain or rope whose opposite end is fastened about the waist, or to the belt mounted about the waist, of the claimber using the device.

In such use, the climber mounts the rungs of the ladder moving upward step by step holding on the sides of the ladder, as in conventional use, but carries the clamping means slidably upon the rail adapted to receive the clamp with the rope or chain connected to the waist of the climber and to the triggering arm of the clamp. In the event of any mishap, such as tripping or falling, the climber and rope pulls down on the triggering arm, forcing the clamp to tightly grip the rail and thus prevent a further fall.

In the present case such clamping, as stated above, is usefully used with a plastic type rail reinforced more than enough to accept the full pull of the climber and the plastic composition tending to allow a small deformation by the bite of the cam element attached to the triggering arm and bearing in operative clamping position with great force against the plastic rail surface, allows firm and immovable gripping of the clamp upon the rail. Thus, both by the plastic substance of the rail slightly deformable by the cam and the strong mechanical force applicable by the inner end of the cam wedgingly pressing against the plastic surface, cooperatively supply an improved clamping combination with a step-ladder.

The invention is further described in relation to the drawings within -

Figure 1:
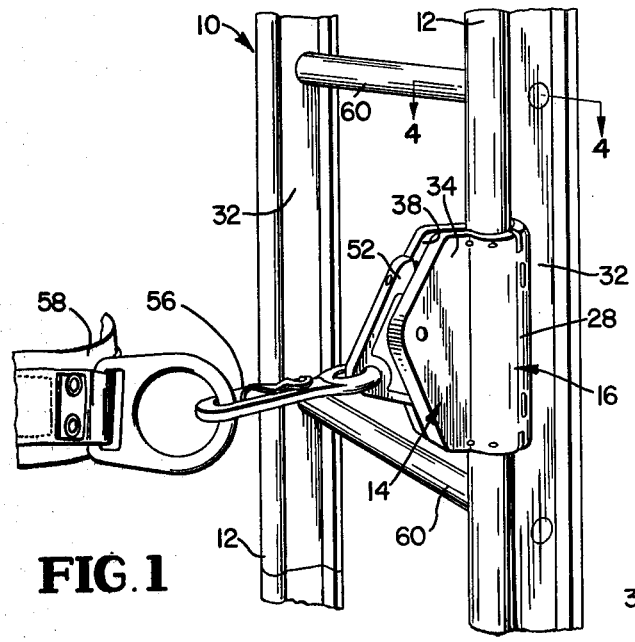
FIG. 1 is a portion of the step-ladder in perspective showing the clamping means slidably mounted to a plastic rail.

Referring to the several figures, a ladder 10 is shown, one or both sides of which comprises or has fastened thereto a fiber reinforced plastic rail 12, shaped to slidingly receive the safety clamp 14. The rail portion 12 is shown here as being round, but can be variously shaped, such as ovular, elliptical, pear shaped or even polyhedrally shaped, such as rectangular, to receive a surrounding and correspondingly fitted clamp portion 16 slidingly thereon.

Figure 3:
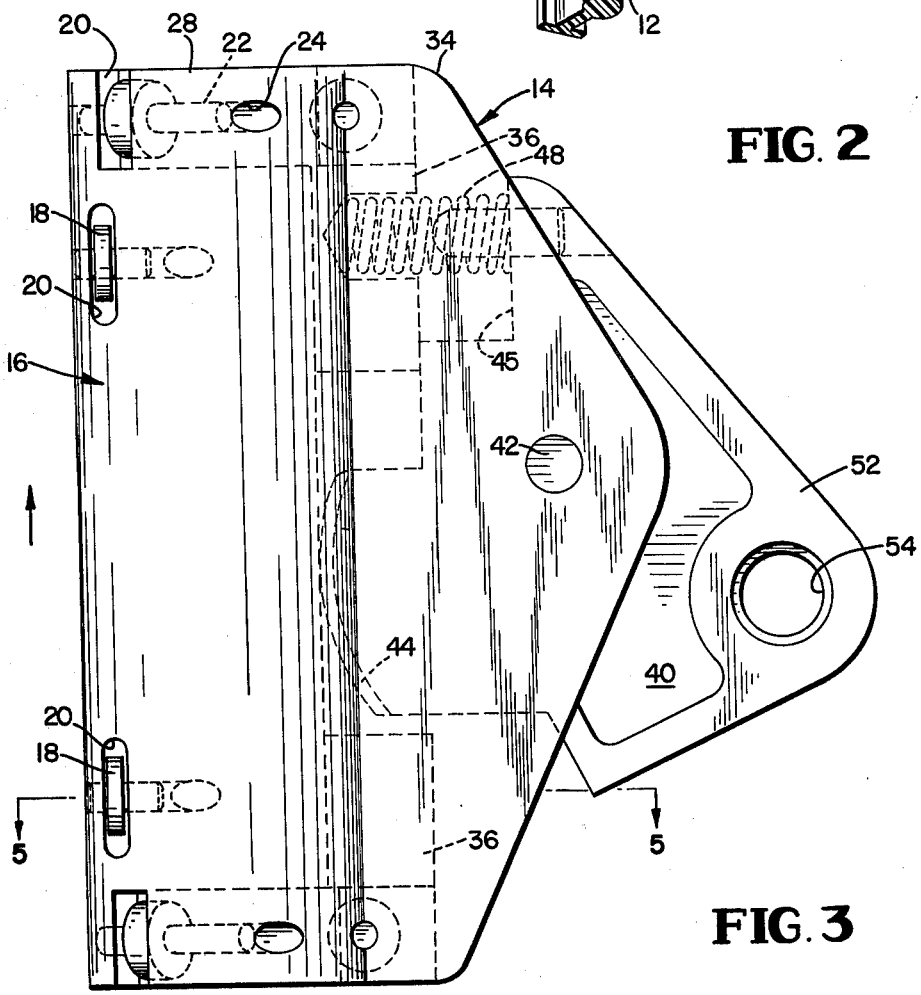
FIG. 3 is a side elevational view of the clamping means.

To promote easy slidability, the clamp has a series of rollers 18, each mounted in a slot 20, for rotation on a pin 22 inserted through a boring 24 inward from the clamp side or annular area, about which several rollers 18 are evenly disposed. The rollers 18 consequently are located radially, disposed as shown about the circular rail to extend from the surrounding clamp surface 26 into the surrounding portion upon the rail and thereby the rollers support and space the clamp from the rail surface to impart sliding clearance therefrom and thus allow easy roller guidance of the clamp in the slected spaced relationship from the surface of the clamp upon the rail. In this manner the several rollers 18 disposed as shown, cooperatively hold the clamp slightly spaced from surface for easy rolling movement thereon. As shown in FIG. 3, a similar set of rollers are disposed at both ends of the clamp for axial support of both ends of the clamp in sliding movement upon the rail.

Figure 4:
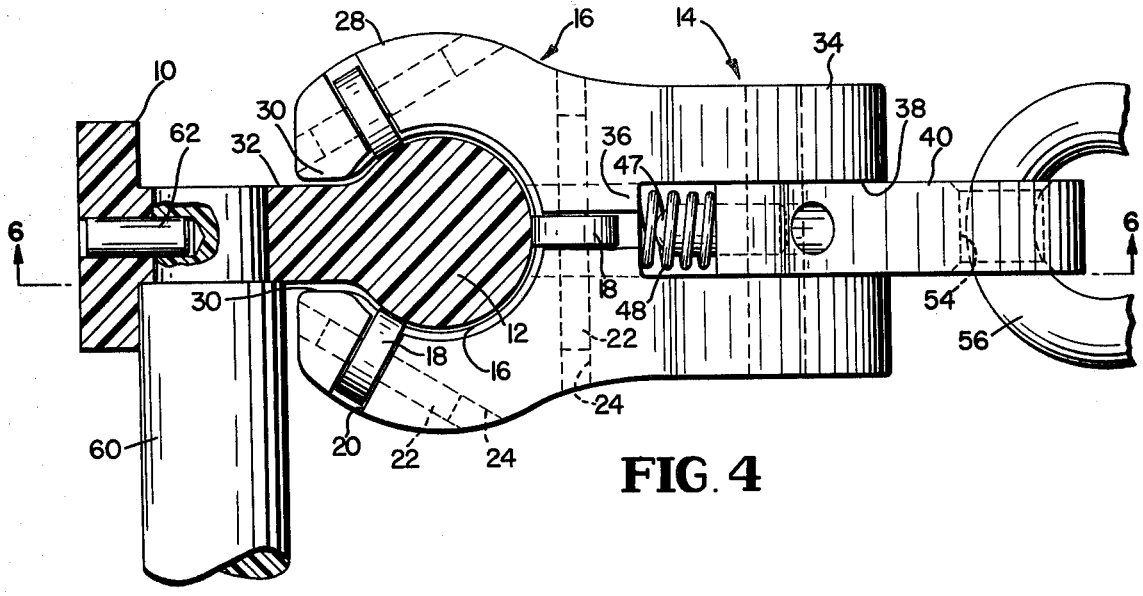
FIG. 4 is an end view of the clamp mounted on a section of the ladder taken on the line 4—4 of FIG. 1.
Figure 6:
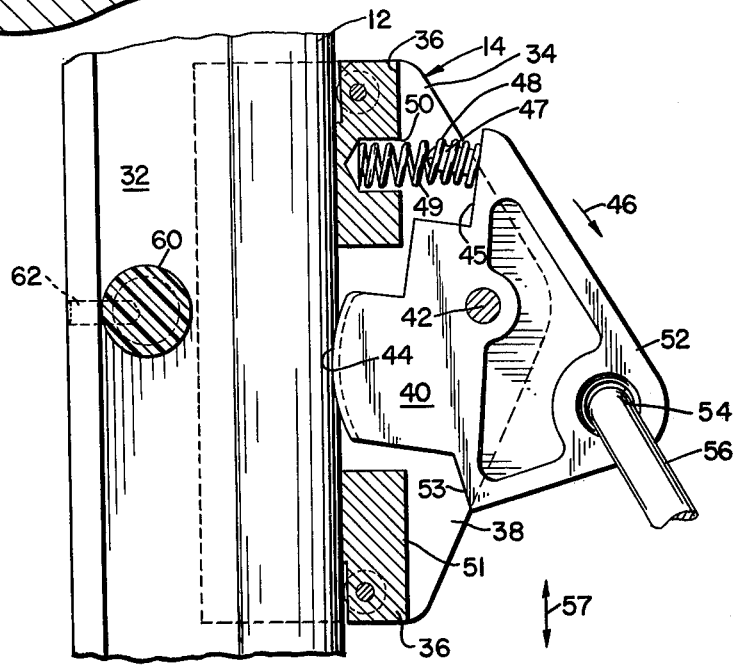
FIG. 6 is a section through the ladder and clamp taken on line 6—6 of FIG. 4.

The clamp body, flaring in corresponding shape at a lower portion 28 to receive the head 12 of the rail, has open jaws 30 on either inner end, separated sufficiently to receive a web portion 32 of the rail against which the lower most rollers 18 bear. As shown in FIGS. 4, 6 the upper portion 34 of the clamp is integrally joined at both sides by the web portion 36 and has an open groove 38 at the top to receive a pivoted cam-like clamping element 40, pivotally mounted on a pin 42 for rotation thereabout in a plane parallel to the access of the rail 12.

Figure 2:
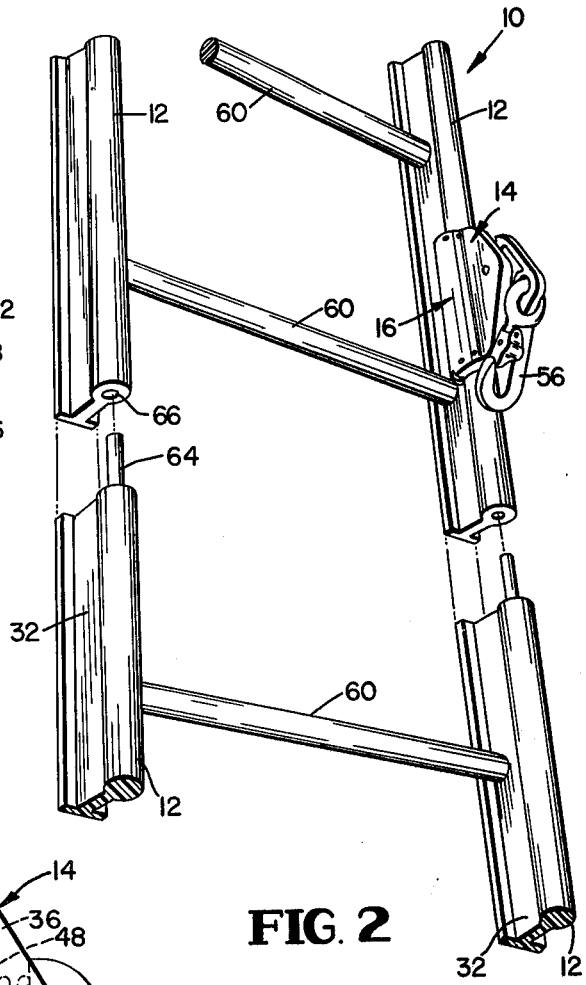
FIG. 2 is a second portion of the ladder and rail mounted clamping means showing the manner of assembly of the reinforced plastic ladder.

The pivotally supported clamping plate 40 has an abutment 45 at its upper end, in the direction of the arrow 57, upon which is mounted an aligning pin 47 extending inward from the abutment and which has a tapared tip 49. The pin 47 supports the outer end of a spring 48 disposed thereabout. The inner end of the spring 48 is retained in a recess 50 bored in the upper end of the connecting section of the clamp body 36 to receive the spring 48 which is thus mounted horizontally in compression bearing against the abutment 45. In that position the spring biases the cam plate 40 on its pivot 42 in the direction of the arrow 46. A cam shaped surface 44 at the inner plate 40 surface is pressed against the surface of the rail 12 by the bias of the spring 48. A stop or shoulder is formed on the after portion of the connecting section 36 and engages a cooperating stop 53 on the plate 40 when the clamp is removed from the rail. The inner face of the cam 44 is shaped with a cam-like curve to bear progressively in its down rotation on its pivot against the surface of the rail 12, fixing the position of the clamp thereon by compression of the spring 48. The face of the cam, as seen in FIG. 2, will be concave to fit the curvature of the rail surface 12 against which it bears evenly. The outer face 52 of the plate 40 extends outward as a shoulder and comprises a triggering arm for activation of the cam 44 by forming a rotational lever for the plate 40 on its pivot. It is as bored at 54 to receive a link 56 of a chain or rope or the like, alternately used in operation of the clamp by movement of the plate 40 in the directions of the arrow 57.

In normal use of the clamp, as shown in FIG. 1, the extending shoulder 52 carries a link of the chain 56 with several intermediate links forming a chain. This chain or rope ultimately fastens to a belt 58 worn around the waist of the climber, ascending or descending the ladder 10, moving upward or downward on the rungs 60 in conventional ladder use. The belt 58 and chain 56 support the clamp pulling it upward or downward upon the surface of the rail 12 in easy sliding movement thereon, made substantially frictionless by the spacing of rollers 18 therearound. The clamp is of sufficient weight so that as bearing slidingly and pulled by the chain or rope 56 supported from the waist of the climber, will bear downward against spring 48 sufficient to prevent the cam surface 44 from impeding the easy sliding movement of the cam upon the rail 12 either in upward or downward movement of the clamp on the surface of the rail 12.

However, in the event of a misstep or fall in which the upward pull on the chain or rope 56 is rapidly terminated or released, both the spring 48 as well as the downward pull on the chain 56 upon trigger arm 52 will bias the cam 44 surface into firm binding and gripping force against the surface 12 of the rail. Thus the clamp attached to the climber will slide easily both upward and downward on the rail in ordinaary use, but the spring 48 will bias the cam into gripping engagement with the rail when the pull is released or downward. The pull upon the clamp in ascent or descent in normal use is merely sufficient to support the clamp about the waist of the climber offsetting the pressure of spring 48 on the plate 40 and prevent the clamp from firmly engaging the rail surface. However, any strong pull downward or even rapid release of the support of the rope or chain upon the cam place will bias the cam surface firmly into gripping engagement of the surface of the rail 12.

Figure 7:
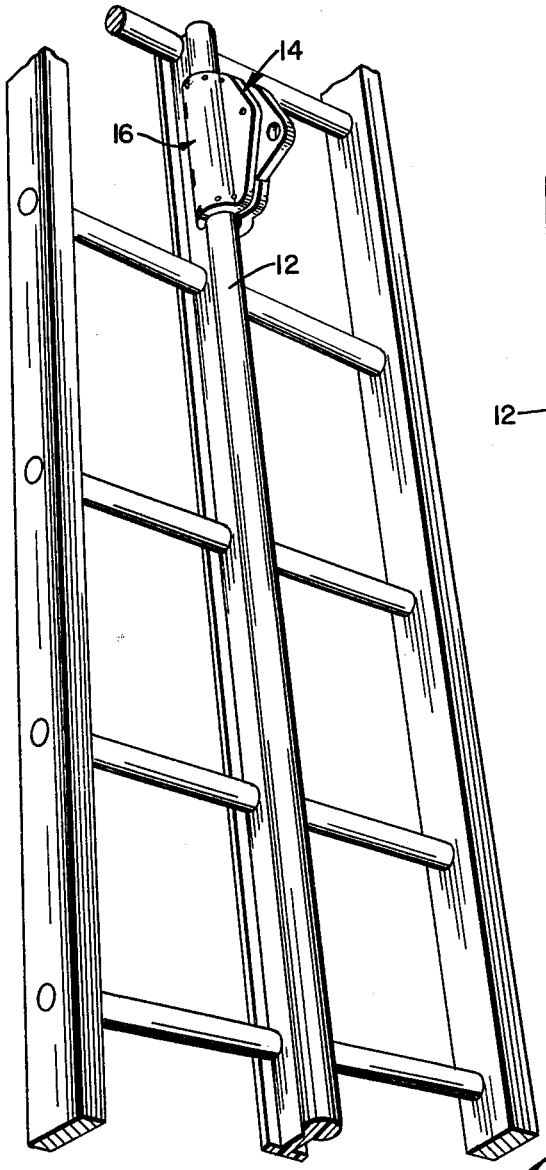
FIG. 7 is a section of a ladder having normal sides with a reinforced plastic rail and clamp mounted centrally to the ladder rungs.
Figure 8:
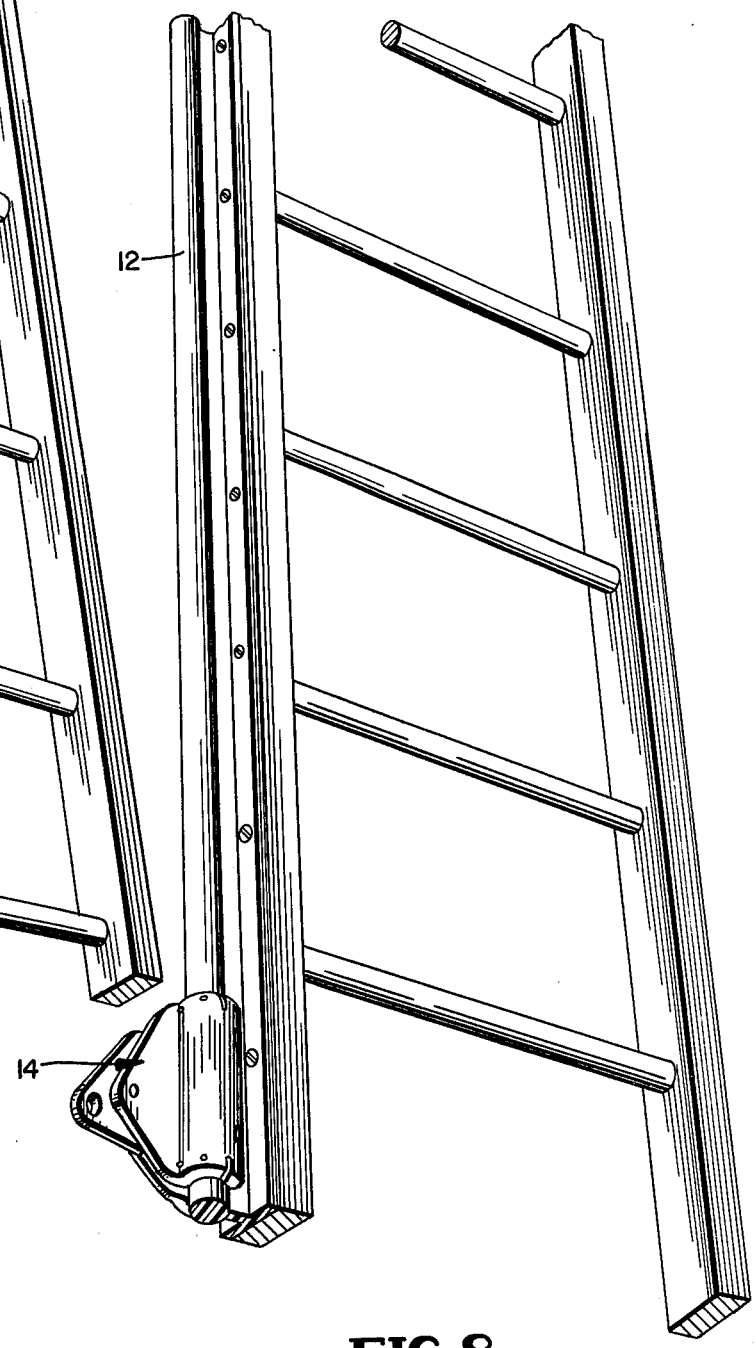
FIG. 8 is a section of a ladder having normal sides with a plastic reinforced rail and the clamp slidably mounted thereon with the rail fastened to one of the sides of the ladder.

As shown in FIGS. 1 and 2, either side rail or both side rails of the step-ladder can be formed with a cam-gripable rail slidable thereon, so that the climber may use whichever side is most convenient for him. In alternate construction, as shown in FIG. 7, the reinforced plastic rail 12 as a separate element may be fastened vertically to the rungs, such as centrally thereof and the clamp disposed slidingly thereon will move centrally as he steps on each rung on either side of the rail, ascending or descending. In a further alternative shown in FIG. 8, the reinforced plastic rail 12 having a clamp receivable surface is fastened to the web at the side of the ladder and the climber may ascend or descend with the clamp mounted slidingly thereon whereby the ladder per se may be of any other construction.

Figure 5:
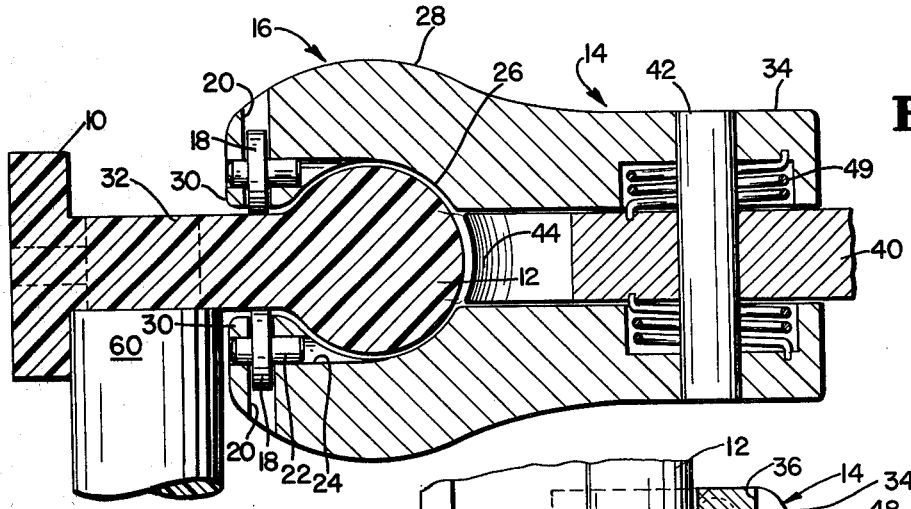
FIG. 5 is a section through the ladder rail mounted clamp taken on the line 5—5 of FIG. 3.

The surface of the rail here shown as round, may have a cam surface 44 as shown in FIG. 5 correspondingly shaped round to correspond to the rail surface 12 for cooperative gripping thereof, the curvature substantially corresponding to the curve of the cam surface which may vary from truly circular to various annular shapes. If the surface were flat and the rail for example were rectangular, the surface of the cam would correspondingly vary in shape to bear against the flat surface. It is preferred, however, for easier more rugged construction and firm gripping to form both the rail surface 12 as well as the cam 44 correspondingly curved.

The ladder itself is formed of reinforced plastic, such as fiber glass reinforced plastic, which supplies a ladder of great strength and light weight. Plastic itself is slightly deformable under the pressure of the cam to allow a firmer non-slipping grip, even if it were wet or even if it were coated with a anti-friction retardant film which still by the slight deformability of the plastic substance supplies the firm gripping engagement by the cam surface pressure of the clamp. In this respect, while a plastic ladder has other advantages, such as light weight, and as reinforced by fiber, great strength, it is superior to metal in being more firmly gripped by the clamp. There are even other advantages, such as easily casting or machineability to unusual shapes and curves as well as easy and quick assembly.

Certain modifications will occur to those skilled in the art. For instance, the compression spring 48 can be replaced with the torsion spring 49 mounted in a hub about the pivot pin 42 with one end fastened thereto and the other to the plate 40 biasing the cam 44 similarily into contact with the rail 12 as shown in FIG. 5.

Again, the ladder 10 may be entirely of plastic as shown in FIG. 2, easily assembled by having connecting mortise pins 64 at one end cooperating with the slots 66, so that separate sections of the ladder may be frictionally gripped or glued together in easy assembly as shown. The obvious advantage of the non-metallic ladder body in addition to the plastic gripping rail 12 is that it can be constructed of light weight, but nevertheless great strength as reinforced by fiber, easily assembled as stated, and may be non-electro conductive, thus having an obvious advantage where the ladder is mounted in exposed positions and where it resists conducting electric current, such as lightening. However, as shown in FIGS. 6 and 7, only the rail itself, placed for easy gripping by the clamp need be of reinforced plastic.

Consequently it is intended that the description herein be regarded illustrative and not limiting, except as defined in the claims appended hereto.

I claim:

1. In combination, a step-ladder having an elongated fiber reinforced plastic rail having a clamp sliding surface shaped to receive a safety clamp, a web extending from and supporting said sliding surface and a base supporting said web and said surface providing clear and free sliding support of said clamp on said surface, a safety clamp sized and shaped to surround and to engage and slide on said rail, said safety clamp having a clamping portion comprising a wide smooth cam-shaped surface evenly bearing in its width against the correspondingly shaped and smooth sliding surface of said rail, said cam surface being alternately positioned to slide easily with said clamp or to bear against and firmly grip the surface of said plastic rail frictionally in a position of clamped engagement therewith, a trigger arm extending from said clamping portion engageable by a rope or chain carried by a climber for easy pull on said trigger arm and clamp to slide said clamp upward or downward on said rail in ascending or descending movement of said climber on said ladder, means above said cam surface biasing said clamping portion into a clamping engagement of said rail, said pull offsetting said bias sufficient to allow easy sliding movement of said clamp in normal upward or downward movement of the climber, said clamping portion being actuated into firmly clamped engagement with the surface of said rail by rapid downward pull of said rope or chain upon said trigger arm.

2. The combination of a reinforced plastic ladder and a clamp slidable on the plastic rail supported by said ladder as defined in claim 1, wherein said rail is supported by said web in full sliding movement of said clamp above the rungs thereof upon said rail and forms at least one side of said ladder with its upper sliding surface shaped annular in cross section to slidingly receive and be frictionally gripped by the cam surface of said clamp; said cam surface being correspondingly curved to mate with the curvature of said rail surface for alternate gripping and sliding engagement therewith.

3. The combination of reinforced plastic ladder and a clamp slidable on the rail supported by said ladder as defined in claim 2, wherein said rail forms at least one side of said ladder with its upper edge shaped substantially circular in cross section to slidingly receive said clamp.

4. The combination of a reinforced plastic ladder and a clamp slidable on the rail supported by said ladder as defined in claim 1, wherein said rail forms at least one side of said ladder and is supported by said web in full sliding movement of said clamp above the rungs thereof, with its upper edge shaped polyhedral in cross section to slidingly receive said clamp.

5. The combination of a reinforced plastic ladder and a clamp slidable on the rail supported by said ladder as defined in claim 4, wherein said rail forms at least one side of said ladder and is supported by said web in full sliding movement of said clamp above the rungs thereof, with its upper edge shaped rectangular in cross section to slidingly receive said clamp.

6. The combination of a reinforced plastic ladder and a clamp slidable on the rail supported by said ladder as defined in claim 1, wherein said ladder is of conventional construction and said rail is fastened to the rungs of said ladder at a position intermediate to the ladder sides said sliding surface being supported by said web in full sliding movement of said clamp above the rungs thereof.

7. The combination of a reinforced plastic ladder and a clamp slidable on the rail supported by said ladder as defined in claim 1, wherein said ladder is of conventional construction and said rail is fastened separately to one of the sides of said ladder said sliding surface being supported by said web in full sliding movement of said clamp above the rungs thereof.

8. A safety clamp for use by climbers having a body portion shaped to engage and slide upon the curved surface of a rail; said rail having a correspondingly curved plastic sliding surface supported by a web to provide full sliding movement of a clamp on said rail surface, and a base for mounting said rail to a ladder a wide clamping plate having an inner cam shaped surface curved to mate with the curvature of said rail surface, said plate being pivotally mounted in said body to bear against and grip the curved plastic surface of said rail and resilient means above said cam surface biasing said clamping plate and cam against said rail surface; said clamping plate having a trigger arm extending laterally from said plate, for connecting to an end of a chain or rope mounted about the body of a climber, the weight of said clamp supported by said trigger arm and rope or chain in movement of the climber pivotally pressing said plate against said biasing means to release said clamp from gripping engagement from said rail surface whereby the clamp is carried slidingly upward or downward along said rail with the movement of said climber, and with rapid pull downward on said chain or rope, pivotally moving said cam portion of said plate into firm gripping engagement with said rail surface.

9. A clamp as defined in claim 8 wherein said biasing means has a spring mounted near the forward end of said plate, biasing said plate and said cam extending therefrom against the surface of said rail when the clamp is mounted about said rail.

10. The clamp as defined in claim 8 wherein said biasing means has springs mounted in torsion about opposite ends of said pivot, with said plate mounted centrally for pivotal movement thereon, one end of each spring being fastened to said body portion near said pivot and the other end fastened to said plate, biasing said plate and cam extending therefrom against a rail surface.

11. The clamp as defined in claim 8 wherein said rail is circular and the cam surface in the area of engagement for gripping said rail is correspondingly curved to fit about and grip the curved surface of said arcuately shaped rail.

12. The clamp as defined in claim 8, wherein clamping body has one end substantially open and shaped to fit about and slide upon a correspondingly shaped rail and a series of rollers mounted in said body near the open end for engaging and rolling upon and guiding the clamp axially upon said rail surface for easy sliding movement thereon.

13. The clamp defined in claim 8 wherein said resilient means is a torsion spring mounted about said pivot and having one end fixed to the cam and the other end to said body, biasing said cam into clamping engagement with said rail surface.

* * * * *